US008052808B2

(12) United States Patent
Kimijima

(10) Patent No.: US 8,052,808 B2
(45) Date of Patent: Nov. 8, 2011

(54) HIGH STRENGTH HOT ROLLED STEEL SHEET WITH EXCELLENT PRESS WORKABILITY AND METHOD OF MANUFACTURING THE SAME

(75) Inventor: Kazuya Kimijima, Kakogawa (JP)

(73) Assignee: Kabushiki Kaisha Kobe Seiko Sho (Kobe Steel, Ltd.), Kobe-shi (JP)

( * ) Notice: Subject to any disclaimer, the term of this patent is extended or adjusted under 35 U.S.C. 154(b) by 70 days.

(21) Appl. No.: 12/037,466

(22) Filed: Feb. 26, 2008

(65) Prior Publication Data

US 2008/0223491 A1 Sep. 18, 2008

(30) Foreign Application Priority Data

Mar. 15, 2007 (JP) ..... 2007-067034

(51) Int. Cl.

| | |
|---|---|
| ***C22C 38/04*** | (2006.01) |
| ***C22C 38/00*** | (2006.01) |
| ***C21D 9/52*** | (2006.01) |
| ***C21D 8/02*** | (2006.01) |

(52) U.S. Cl. ..... 148/337; 148/330; 148/601; 148/602; 420/120

(58) Field of Classification Search ..... 148/330, 148/337, 601, 602; 420/120
See application file for complete search history.

(56) References Cited

U.S. PATENT DOCUMENTS

2006/0231166 A1 10/2006 Okamoto et al.

FOREIGN PATENT DOCUMENTS

| | | | | |
|---|---|---|---|---|
| CN | 1759198 | A | | 4/2006 |
| CN | 101400816 | A | | 4/2009 |
| EP | 1 681 362 | A1 | | 7/2006 |
| JP | 57-23025 | | | 2/1982 |
| JP | 6-264184 | | | 3/1993 |
| JP | 7-48648 | | | 2/1995 |
| JP | 2000-144259 | | | 5/2000 |
| JP | 2001-226741 | | | 8/2001 |
| JP | 2001-342543 | | | 12/2001 |
| JP | 2002-20838 | | | 1/2002 |
| JP | 2003-342684 | | | 12/2003 |
| JP | 2004-323917 | | | 11/2004 |
| JP | 2005-248240 | | | 9/2005 |
| JP | 2005248240 | A | * | 9/2005 |
| JP | 2006118007 | A | * | 5/2006 |
| JP | 2006-161111 | | | 6/2006 |
| WO | WO 2006/103991 | A1 | | 10/2006 |
| WO | WO 2007/122910 | A1 | | 11/2007 |

* cited by examiner

*Primary Examiner* — Roy King
*Assistant Examiner* — Caitlin Kiechle
(74) *Attorney, Agent, or Firm* — Oblon, Spivak, McClelland, Maier & Neustadt, L.L.P.

(57) ABSTRACT

Disclosed is a hot rolled steel sheet which contains C, Si, Mn, Al, Ti, N, and S. The C, Ti, N, and sulfur contents satisfy the following condition (1), and the Si and Mn contents satisfy the following condition (2):

$$[C]-\{[Ti]-(48/14)\times[N]-(48/32)\times[S]\}/4\leqq 0.01 \quad (1)$$

$$0.20\leqq([Si]/[Mn])\leqq 0.85 \quad (2)$$

in which the symbol [X] represents the content (percent by mass) of the element X, and the steel sheet has a microstructure having an area percentage of bainitic ferrite of 90% or more, an area percentage of martensite of 5% or less, and an area percentage of bainite of 5% or less, based on the area of an observed field. This steel sheet excels in properties demanded in press working, such as shape freezing ability, hole-expandability, and bendability, even though it has a high tensile strength of 980 MPa or more.

11 Claims, 1 Drawing Sheet

HIGH STRENGTH HOT ROLLED STEEL SHEET WITH EXCELLENT PRESS WORKABILITY AND METHOD OF MANUFACTURING THE SAME

FIELD OF THE INVENTION

The present invention relates to high strength hot rolled steel sheets applied typically to automobile structural members, and methods of manufacturing the same. More specifically, it relates to techniques for providing high strength hot rolled steel sheets having improved press workabilities.

BACKGROUND OF THE INVENTION

Components typically of automobiles are manufactured by subjecting steel sheets to press working. Burring (hole expanding) and/or bending is carried out in the press working process. The material steel sheets subjected to press working desirably have hole-expandability (also called "stretch-flangeability") and/or bendability. The material steel sheets subjected to press working also desirably have shape freezing ability, so as to fabricate components having desired shapes with good dimensional accuracy. In particular, pillars and other structural components of automobiles should have further increased strength so as to improve collision safety of automobiles, and high strength thin steel sheets having tensile strengths of 980 MPa or more are to be adopted thereto.

Accordingly, material steel sheets subjected to press working should have both high tensile strengths of 980 MPa or more and satisfactory press workabilities such as hole-expandability, bendability, and shape freezing ability.

Japanese Unexamined Patent Application Publication (JP-A) No. 2006-161111 discloses a technique of providing a steel sheet having an increased strength and improved hole-expandability (stretch-flangeability). This steel sheet has a ferrite single phase microstructure and contains elements which form carbide precipitates, such as Ti, Nb, V, and Mo, in the microstructure to cause precipitation strengthening to thereby have an increased strength. However, as is described in this document, the steel sheet having an increased strength due to precipitation strengthening has an increased yield ratio and thereby has deteriorated shape freezing ability.

JP-A No. 2005-248240 proposes a technique of providing a hot rolled steel sheet having a strength exceeding 490 MPa and showing improved hole-expandability (stretch-flangeability). This technique achieves a strength on the order of exceeding 490 MPa and gives improved hole-expandability (stretch-flangeability) by allowing the steel sheet to have a microstructure mainly containing bainitic ferrite and by suitably controlling the average grain size of prior-austenite grains. This document also teaches that hole-expandability (stretch-flangeability) can be improved by suppressing localization of elements that cause intergranular embrittlement, such as phosphorus (P), in a system in which precipitation of coarse carbides is suppressed by the action typically of titanium (Ti).

Although giving consideration to hole-expandability (stretch-flangeability), the document (JP-A No. 2005-248240) does not give consideration to bendability and shape freezing ability of steel sheets.

SUMMARY OF THE INVENTION

Under these circumstances, an object of the present invention is to provide a hot rolled steel sheet that excels in all properties required in press working, including shape freezing ability, hole-expandability, and bendability, even though it has a high strength in terms of tensile strength of 980 MPa or more.

Specifically, according to an embodiment of the present invention, there is provided a hot rolled steel sheet which contains 0.010 to 0.05 percent by mass carbon (C); 0.5 to 2.5 percent by mass silicon (Si); 2.5 to 3.5 percent by mass manganese (Mn); 0.01 to 0.1 percent by mass aluminum (Al); 0.30 percent by mass or less (excluding 0 percent by mass) titanium (Ti); 0.008 percent by mass or less nitrogen (N); and 0.005 percent by mass or less sulfur (S). In this steel sheet, the contents of C, Ti, N, and S satisfy the following condition (1), and the contents of Si and Mn satisfy the following condition (2):

$$[C]-\{[Ti]-(48/14)\times[N]-(48/32)\times[S]\}/4\leqq 0.01 \quad (1)$$

$$0.20\leqq([Si]/[Mn])\leqq 0.85 \quad (2)$$

wherein the symbol [X] represents a content (percent by mass) of an element X. The hot rolled steel sheet has a microstructure containing an area percentage of bainitic ferrite of 90 percent by area or more; an area percentage of martensite of 5 percent by area or less; and an area percentage of bainite of 5 percent by area or less, based on the area of an observed field.

The steel sheet may further contain, as other elements, (a) at least one selected from the group consisting of 0.03 to 0.5 percent by mass copper (Cu), 0.03 to 0.5 percent by mass nickel (Ni), 0.1 to 0.8 percent by mass chromium (Cr), 0.01 to 0.5 percent by mass molybdenum (Mo), 0.005 to 0.1 percent by mass niobium (Nb), 0.005 to 0.1 percent by mass vanadium (V), and 0.0005 to 0.005 percent by mass boron (B) and/or (b) 0.0005 to 0.005 percent by mass calcium (Ca).

The high strength hot rolled steel sheet may be manufactured by hot-rolling a steel slab having the above-mentioned composition at 1100° C. or higher with finish rolling at a finishing delivery temperature equal to or higher than an $Ar_3$ transformation temperature to yield a hot rolled steel sheet, cooling the hot rolled steel sheet from the finishing delivery temperature to a coiling temperature at an average cooling rate of 50° C. per second or more to yield a cooled steel sheet, and coiling the cooled steel sheet at a temperature of 600° C. to 300° C.

A steel sheet according to an embodiment of the present invention is a steel sheet having a microstructure in which bainitic ferrite occupies 90 percent by area or more of the area of an observed field. This steel sheet has suitably adjusted contents of C, Ti, N, and S, is thereby unlikely to contain cementite, and is reduced in dissolved carbon. This prevents the formation of a bainite-based microstructure containing precipitated cementite in bainitic ferrite and thereby improves, among press workabilities, hole-expandability. The steel sheet is also unlikely to form martensite, because it has suitably adjusted contents of C, Ti, N, and S to thereby control the dissolved carbon content. This improves, among press workabilities, hole-expandability and bendability.

In addition, the steel sheet has an increased tensile strength of 980 MPa or more, because it has suitably adjusted and well-balanced contents of Si and Mn. Although a detailed mechanism remains unknown, the precipitation of carbides can be inhibited by suitably adjusting the contents of Si and Mn and the balance between them in the steel sheet. This improves, among press workabilities, shape freezing ability.

Thus, according to an embodiment of the present invention, there is provided a hot rolled steel sheet that has a high strength of 980 MPa or more and excels in press workabilities, i.e., shape freezing ability, hole-expandability, and bendability.

DETAILED DESCRIPTION OF THE PREFERRED EMBODIMENTS

Figure 1:
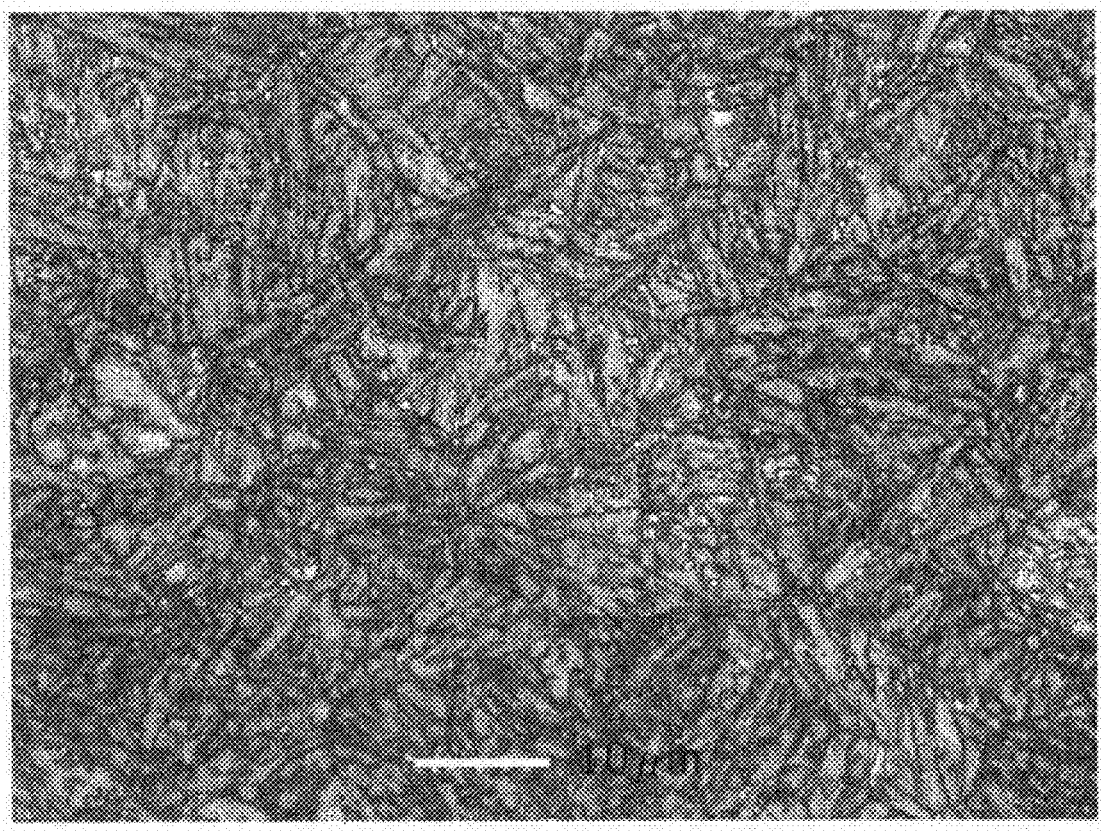
FIG. 1 shows an optical photomicrograph of Sample No. 2 in Table 2.

Steel sheets for use in the automobile industry should have further higher strengths to reduce the body weights. However, if a steel sheet contains elements that form carbide precipitates so as to promote precipitation strengthening to thereby increase the strength as in the technique disclosed in JP-A No. 2006-161111, the steel sheet has an increased yield ratio and is poor in, among press workabilities, shape freezing ability.

On the other hand, JP-A No. 2005-248240 discloses a technique for improving hole-expandability (stretch-flangeability). After investigations, however, the present inventors found that bendability of hot rolled steel sheets is not improved even when the hole-expandability (stretch-flangeability) thereof is improved as in JP-A No. 2005-248240. Specifically, they found that the hole-expandability (stretch-flangeability) and bendability of hot rolled steel sheets are not in correlation relationship with each other. This will be described in detail with reference to after-mentioned Experimental Examples.

The present inventors therefore made intensive investigations to provide a hot rolled steel sheet having a high strength of 980 MPa or more and excelling in press workabilities including shape freezing ability, hole-expandability, and bendability. As a result, they have found that a steel sheet can have both high strength and excellent press workabilities and can have, among press workabilities, well-balanced satisfactory hole-expandability and bendability by suitably controlling the element composition and the microstructure of the steel sheet. The present invention has been made based on these findings. Hot rolled steel sheets according to embodiments of the present invention will be illustrated below.

Initially, the microstructure of a hot rolled steel sheet according to an embodiment of the present invention will be illustrated. The microstructure of the hot rolled steel sheet has a bainitic ferrite fraction of 90 percent by area or more based on the area of an observed field (hereinafter such a microstructure is also referred to as "bainitic ferrite-based" microstructure). This microstructure also has a reduced martensite fraction of 5 percent by area or less (including 0 percent by area) and a reduced bainite fraction of 5 percent by area or less (including 0 percent by area).

Suppression of the formation of martensite improves, among press workabilities, hole-expandability and bendability. Inhibition of the formation of bainite improves, among press workabilities, hole-expandability. Specifically, the formation of cementite can be suppressed and the dissolved carbon can be reduced by suitably adjusting and balancing the contents of C, Ti, N, and Sin the steel sheet so as to satisfy the following condition (1). The resulting steel sheet becomes unlikely to contain bainite and has improved hole-expandability. In addition, the steel sheet is prevented from containing excessive dissolved carbon by suitably adjusting and balancing the contents of C, Ti, N, and S in the steel sheet so as to satisfy the condition (1). The steel sheet thereby becomes unlikely to contain martensite and has, among press workabilities, improved hole-expandability and bendability.

In the steel sheet, the formation of martensite and bainite is suppressed, and bainitic ferrite occupies 90 percent by area or more of the area of an observed field. However, a steel sheet may not have a tensile strength of 980 MPa or more, if it merely has a bainitic ferrite-based microstructure.

Accordingly, the steel sheet has such an element composition that a Z value calculated from the contents of Si and Mn satisfy the following condition (2). By adjusting the contents of Si and Mn to satisfy the condition (2), the steel sheet can have a high strength of 980 MPa or more while having a bainitic ferrite-based microstructure. This achieves high strength without adversely affecting, among press workabilities, hole-expandability and bendability. In addition, by adjusting the contents of Si and Mn to satisfy the condition (2), the formation of carbides such as titanium carbide is suppressed, and this improves, among press workabilities, shape freezing ability, although a reaction mechanism of this still remains unknown.

A hot rolled steel sheet according to an embodiment of the present invention has only to have such a microstructure that bainitic ferrite constitutes a phase having a largest area percentage in an observed field of microstructure of the steel sheet. The area percentage of bainitic ferrite may be 90% or more. It is preferably 93% or more, and more preferably 95% or more, based on the area of an observed field. The term "bainitic ferrite" means sheet-like ferrite which is a substructure with a high dislocation density.

Martensite contained in an area percentage up to about 5 percent by area based on the area of an observed field is acceptable, but it is desirably minimized. The area percentage of martensite is preferably 3% or less, more preferably 2% or less, and most preferably 0%.

Bainite contained in an area percentage up to about 5 percent by area based on the area of an observed field is acceptable, but it is desirably minimized. The area percentage of bainite is preferably 3% or less, more preferably 2% or less, and most preferably 0%.

The hot rolled steel sheet may have, as a microstructure, a bainitic ferrite single phase microstructure or a mixed phase microstructure mainly containing bainitic ferrite and further containing martensite and/or bainite. The hot rolled steel sheet may also include any other microstructure (s) in an area percentage of 10 percent by area or less based on the area of an observed field, in addition to bainitic ferrite, martensite, and bainite. Examples of the other microstructures include polygonal ferrite and pearlite. However, if a steel sheet includes other microstructures such as polygonal ferrite and pearlite in an area percentage exceeding 10 percent by area, it is difficult to allow the resulting steel sheet to have both high strength and satisfactory press workabilities, in contrast to the steel sheet according to an embodiment of the present invention.

Specifically, if a steel sheet contains an excessively large amount of polygonal ferrite, the steel sheet should contain precipitates typically of titanium compounds and undergo precipitation strengthening in order to have a high strength of 980 MPa or more. However, the steel sheet underwent precipitation strengthening has an increased yield ratio and becomes poor in, among press workabilities, shape freezing ability. In contrast, if a steel sheet contains an excessively large amount of pearlite, the steel sheet contains a large amount of lamellar cementite, thereby has reduced local deformation ability, and becomes poor in, among press workabilities, hole-expandability and bendability.

The bainitic ferrite can be distinguished from other microstructures by subjecting a cross section in a thickness direction of a sample hot rolled steel sheet to etching with a repeller and observing microstructures of a cross section of the etched sample with an optical microscope. The area percentages of respective microstructures can be determined by analyzing observed images.

As is described above, a hot rolled steel sheet according to an embodiment of the present invention has a bainitic ferrite-based microstructure in which the formation of martensite and bainite is suppressed. The hot rolled steel sheet essentially contains, as chemical components, 0.010 to 0.05 percent by mass C; 0.5 to 2.5 percent by mass Si; 2.5 to 3.5 percent by mass Mn; 0.01 to 0.1 percent by mass Al; 0.30 percent by mass or less of Ti; 0.008 percent by mass or less of N; and 0.005 percent by mass or less of S. In addition, the contents of C, Ti, N, and S satisfy the following condition (1), and the contents of Si and Mn satisfy the following condition (2):

$$[C]-\{[Ti]-(48/14)\times[N]-(48/32)\times[S]\}/4\leqq 0.01 \quad (1)$$

$$0.20\leqq([Si]/[Mn])\leqq 0.85 \quad (2)$$

In the conditions (1) and (2), the symbol [X] represents a content (percent by mass) of an element X. The left side value of the condition (1), namely, the value represented by "$[C]-\{[Ti]-(48/14)\times[N]-(48/32)\times[S]\}/4$" is also referred to as "Y value". The middle side value in the condition (2), namely the value represented by "[Si]/[Mn]" is hereinafter also referred to as "Z value".

Reasons for specifying these ranges of chemical components and the conditions will be explained below.

Initially, the condition (1) will be explained. The Y value is calculated from the contents of C, Ti, N, and S. A Y value satisfying the condition (1) mainly improves press workabilities of the hot rolled steel sheet. Such Y value indicates the balance among C, Ti, N, and S. In particular, when titanium (Ti) is contained in such a content as to satisfy the condition (1), this reduces dissolved carbon, suppresses the formation of cementite, and thereby suppresses the formation of martensite and bainite in the steel sheet, because titanium element is likely to bond with carbon (C). By suppressing the formation of cementite, the hot rolled steel sheet can have a bainitic ferrite-based microstructure, and this especially improves hole-expandability among press workabilities. In addition, the suppression of the formation of martensite improves not only hole-expandability but also bendability. Titanium (Ti) also functions to form nitrides and sulfides to thereby fix nitrogen (N) and sulfur (S). Thus, by containing titanium in such a content as to satisfy the condition (1), the steel sheet can be improved in bendability among press workabilities.

However, if the Y value exceeds 0.01, the steel sheet contains a larger amount of dissolved carbon and a larger amount of precipitated cementite and thereby is poor in hole-expandability among press workabilities. In addition, the steel sheet contains an increased amount of martensite and is thereby poor in hole-expandability and bendability. Accordingly, the Y value is set to 0.010 or less. It is preferably 0.005 or less, and more preferably 0 or less. The lower limit of the Y value is, for example, about −0.040.

However, an excessively high Ti content causes excessive dissolved titanium, and this may deteriorate, among press workabilities, hole-expandability and bendability, even when the Y value satisfies the above-specified range. Accordingly, the Ti content is set to 0.30 percent by mass or less. The Ti content is preferably 0.25 percent by mass or less, and more preferably 0.20 percent by mass or less (excluding 0 percent by mass).

Reasons for specifying the contents of C, Ti, N, and S are as follows.

Carbon (C) element forms bainitic ferrite in the steel sheet to thereby ensure satisfactory strength. Accordingly, the carbon content should be 0.010 percent by mass or more. It is preferably 0.020 percent by mass or more, and more preferably 0.030 percent by mass or more. However, if a steel sheet contains carbon in a content exceeding 0.05 percent by mass, the steel sheet may contain large amounts of martensite and bainite and be poor in press workabilities typified by hole-expandability and bendability. It may also be poor in weldability. Accordingly, the carbon content is set to 0.05 percent by mass or less. It is preferably 0.048 percent by mass or less, and more preferably 0.045 percent by mass or less.

Nitrogen (N) element forms crystallized coarse inclusions, such as TiN, in the manufacturing of slab and adversely affects hole-expandability and bendability among press workabilities. Accordingly, the nitrogen content is set to 0.008 percent by mass or less. It is preferably 0.005 percent by mass or less, and more preferably 0.004 percent by mass or less. It is desirable to minimize the nitrogen content.

Sulfur (S) element forms crystallized coarse inclusions, such as MnS, in the manufacturing of slab and adversely affects hole-expandability and bendability among press workabilities. Accordingly, the sulfur content is set to 0.005 percent by mass or less. The sulfur content is preferably 0.004 percent by mass or less, and more preferably 0.003 percent by mass or less. It is desirable to minimize the sulfur content.

Next, the condition (2) will be explained. The Z value is calculated from the contents of Si and Mn. The Z value, if satisfying the condition (2), mainly increases the strength of the hot rolled steel sheet. In addition, although its reaction mechanism remains unknown, this also suppresses the formation of carbides typically of titanium and thereby improves shape freezing ability.

The condition (2) indicates the balance between Si and Mn. Specifically, if the Mn content is set to a larger amount than that in common steels as described later, silicon (Si) is contained in a proper amount with respect to the increased Mn content according to the condition (2). More specifically, manganese (Mn) element suppresses the formation of polygonal ferrite, and silicon (Si) element promotes the formation of polygonal ferrite. If a steel sheet contains a relatively large amount of silicon to manganese, the formation of polygonal ferrite is excessively promoted, and the steel sheet may not have a bainitic ferrite-based microstructure. In addition, a relatively large amount of silicon does not effectively suppress carbides typically of titanium, and the steel sheet has an increased yield ratio and becomes poor in shape freezing ability among press workabilities, although its reaction mechanism remains unknown.

Accordingly the Z value is set to 0.85 or less. It is preferably 0.80 or less, and more preferably 0.70 or less. However, if the Z value is less than 0.20, manganese is contained in a relatively large amount to silicon. This causes a large amount of martensite as a hard second phase and thereby adversely affects hole-expandability and bendability among press workabilities. Accordingly the Z value is set to 0.20 or more. It is preferably 0.25 or more, and more preferably 0.30 or more.

Reasons for specifying the ranges of the contents of silicon and manganese are as follows.

Silicon (Si) element causes solid-solution strengthening and contributes to increased strength of the steel sheet. In addition, it suppresses the formation of cementite and allows the steel sheet to have a bainitic ferrite-based microstructure. Accordingly the Si content should be 0.5 percent by mass or more. It is preferably 0.7 percent by mass or more, and more preferably 1.0 percent by mass or more. However, if silicon is contained in a content exceeding 2.5 percent by mass, the effects of silicon are saturated, and the formation of excessive polygonal ferrite in the microstructure is promoted. This adversely affects strength and press workabilities typified by hole-expandability and bendability. Accordingly the Si content is set to 2.5 percent by mass or less. It is preferably 2.3 percent by mass or less, and more preferably 2.0 percent by mass or less.

Manganese (Mn) element also acts as a solid-solution strengthening element and contributes to increased strength of the steel sheet, as with silicon. It also acts to increase hardenability and allows the steel sheet to have a bainitic ferrite-based microstructure. However, in order mainly to increase its strength, the hot rolled steel sheet according to an embodiment of the present invention should contain a larger amount of manganese than that in known bainitic ferrite steels. This is because, by containing a larger amount of manganese than known steel sheets, the steel sheet can have desired properties without undergoing precipitation strengthening and the formation of a hard second phase, even though the steel sheet has a bainitic ferrite-based microstructure. Specifically, the hot rolled steel sheet excels in press workabilities, i.e., hole-expandability, bendability, and shape freezing ability, even though it has an increased strength in terms of tensile strength typically of 980 MPa or more, because it does not contain such precipitates and hard second phase.

The Mn content should be 2.5 percent by mass or more. It is preferably 2.6 percent by mass or more, and more preferably 2.7 percent by mass or more. However, excessive manganese may cause manganese segregation, and the resulting steel sheet may not have homogeneous properties. Accordingly, the Mn content is set to 3.5 percent by mass or less and is preferably 3.2 percent by mass or less, and more preferably 3.0 percent by mass or less.

The Y value may be adjusted by suitably controlling the amounts of silicon and manganese added during melting.

The hot rolled steel sheet according to an embodiment of the present invention contains C, Ti, N, and S in such contents as to satisfy the condition (1); contains Si and Mn in such contents as to satisfy the condition (2); and further contains aluminum (Al).

Aluminum (Al) element deoxidizes molten steel and should be contained in an amount of 0.01 percent by mass or more. The Al content is preferably 0.02 percent by mass or more, and more preferably 0.03 percent by mass or more. However, an excessively large amount of aluminum may cause large amounts of non-metal inclusions, whereby elongation of the steel sheet may deteriorate. In addition, such a large amount of aluminum may cause increased cost. Accordingly the Al content is set to 0.1 percent by mass or less. It is preferably 0.06 percent by mass or less, and more preferably 0.04 percent by mass or less.

The basic components of the hot rolled steel sheet are as mentioned above. The remainder is iron and inevitable impurities. In another embodiment of the present invention, the steel sheet may further contain, as other elements, (a) at least one selected from the group consisting of 0.03 to 0.5 percent by mass copper (Cu), 0.03 to 0.5 percent by mass nickel (Ni), 0.1 to 0.8 percent by mass chromium (Cr), 0.01 to 0.5 percent by mass molybdenum (Mo), 0.005 to 0.1 percent by mass niobium (Nb), 0.005 to 0.1 percent by mass vanadium (V), and 0.0005 to 0.005 percent by mass boron (B) and/or (b) 0.0005 to 0.005 percent by mass calcium (Ca). Reasons for specifying these ranges are as follows.

(a) Copper (Cu), nickel (Ni), chromium (Cr), molybdenum (Mo), niobium (Nb), vanadium (V), and boron (B) elements each act to increase hardenability. By controlling the contents of these elements within the above-specified ranges, the steel sheet may become more likely to have a bainitic ferrite-based microstructure. However, these elements, if contained in excessively large amounts, may cause carbides, nitrides, and/or carbonitrides or may cause a hard second phase in the steel sheet, and this may adversely affect press workabilities typified by shape freezing ability. When boron (B) is contained in excess, the advantages of this element may be saturated.

The Cu content is preferably 0.5 percent by mass or less, more preferably 0.3 percent by mass or less, and furthermore preferably 0.1 percent by mass or less. For effectively exhibiting the advantages, the lower limit of the Cu content is preferably set to, for example, 0.03 percent by mass.

The Ni content is preferably 0.5 percent by mass or less, more preferably 0.3 percent by mass or less, and furthermore preferably 0.2 percent by mass or less. For effectively exhibiting the advantages, the lower limit of the Ni content is preferably set to, for example, 0.03 percent by mass.

The Cr content is preferably 0.8 percent by mass or less, and more preferably 0.6 percent by mass or less. For effectively exhibiting the advantages, the lower limit of the Cr content is preferably set to, for example, 0.1 percent by mass.

The Mo content is preferably 0.5 percent by mass or less, more preferably 0.3 percent by mass or less, and furthermore preferably 0.1 percent by mass or less. For effectively exhibiting the advantages, the lower limit of the Mo content is preferably set to, for example, 0.01 percent by mass.

The Nb content is preferably 0.1 percent by mass or less, and more preferably 0.05 percent by mass or less. For effectively exhibiting the advantages, the lower limit of the Nb content is preferably set to, for example, 0.005 percent by mass.

The vanadium content is preferably 0.1 percent by mass or less, and more preferably 0.05 percent by mass or less. For effectively exhibiting the advantages, the lower limit of the vanadium content is preferably set to, for example, 0.005 percent by mass.

The boron content is preferably 0.005 percent by mass or less, and more preferably 0.003 percent by mass or less. For effectively exhibiting the advantages, the lower limit of the boron content is preferably set to, for example, 0.0005 percent by mass.

Each of Cu, Ni, Cr, Mo, Nb, V, and B can be contained alone or in any combination in the steel sheet.

(b) Calcium (Ca) element acts to make inevitable sulfide inclusions, such as MnS inclusions, have finer sizes in the steel sheet and to thereby improve press workabilities typified by hole-expandability. However, the advantages of calcium, if contained in excess, may become saturated and cause increased cost. Accordingly the Ca content is preferably 0.005 percent by mass or less, and more preferably 0.003 percent by mass or less. For effectively exhibiting the advantages, the lower limit of the Ca content is preferably set to, for example, 0.0005 percent by mass.

Even if Mg, Sn, Zn, Zr, W, As, Pb, Bi, Cs, Rb, Co, La, Tl, Nd, Y, In, Be, Hf, and Tc are contained in the steel sheet in the total content of 0.01% or less, the effects of the present invention are not lost, and corrosion resistance and delayed fracture resistance are improved depending on the total amount.

Next, a method of manufacturing a hot rolled steel sheet according to an embodiment of the present invention will be illustrated. The hot rolled steel sheet can be manufactured by hot-rolling a steel slab at 1100° C. or higher with finish rolling at a finishing delivery temperature equal to or higher than an $Ar_3$ transformation temperature to yield a hot rolled steel sheet. The steel slab has an element composition within the above-specified ranges.

By subjecting a steel slab at 1100° C. or higher to hot rolling, the steel slab undergoes solid-solution of titanium again, whereby the resulting hot-rolled sheet has a bainitic ferrite-based microstructure. The temperature of the steel slab is preferably as high as possible to make titanium undergo solid solution reliably, and is preferably 1200° C. or higher. However, an excessively high temperature of the steel slab may cause thick scale on the surface of the steel slab. This may increase scaling loss and thereby reduce a yield. Accordingly the temperature of the steel slab is preferably about 1400° C. or lower.

It is acceptable that a steel slab having an element composition within the above-specified ranges is once cooled to a temperature lower than 1100° C. and reheated to 1100° C. or higher before hot rolling or that a steel slab at 1100° C. or higher immediately after casting is subjected to hot rolling without cooling.

The hot rolling may be carried out according to a common procedure in which rough rolling and finish rolling are conducted in this order. The finish rolling should be completed at a finishing delivery temperature equal to or higher than an $Ar_3$ transformation temperature. If the finishing delivery temperature is lower than the $Ar_3$ transformation temperature, polygonal ferrite may be formed, whereby the steel sheet may fail to have a bainitic ferrite-based microstructure. The upper limit of the finishing delivery temperature is not particularly limited but is preferably set to about 950° C., because an excessively high finishing delivery temperature may cause scale defects.

After the completion of finish rolling, the hot-rolled steel sheet may be cooled from the finishing delivery temperature to a coiling temperature at an average cooling rate of 50° C. per second or more and may be coiled at 600° C. to 300° C.

After the completion of finish rolling, the hot-rolled steel sheet is cooled to the after-mentioned coiling temperature. In this process, the average cooling rate from the finishing delivery temperature to the coiling temperature is set to about 50° C. per second or more. If the average cooling rate is less than about 50° C. per second, the steel sheet may fail to have a bainitic ferrite-based microstructure. The average cooling rate is preferably 70° C. per second or more. The upper limit of the average cooling rate is not particularly limited but may be about 120° C. per second in real operation.

If the coiling temperature exceeds 600° C., other microstructures such as polygonal ferrite and pearlite may occur and the steel sheet may fail to have a bainitic ferrite-based microstructure. Accordingly the coiling temperature is set to 600° C. or lower and is preferably 500° C. or lower. However, if the coiling temperature is excessively low, the microstructure may have an excessively high dislocation density, whereby the steel sheet may have deteriorated elongation. Accordingly the coiling temperature is set to 300° C. or higher and is preferably 400° C. or higher.

Such hot rolled steel sheets according to embodiments of the present invention excel in press workabilities typified by local deformation processabilities such as hole-expandability (stretch-flangeability) and bendability, and shape freezing ability, even though they have high strengths in terms of tensile strength on the order of 980 MPa or more. Such high strength is expected to be demanded more and more in future. The hot rolled steel sheets are therefore advantageously used typically as reinforcing materials for members, bumpers, and pillars of automobiles.

The hot rolled steel sheets can exhibit advantages as intact or after surface treatment such as zinc plating. Accordingly, such steel sheets with treated surfaces are also included within the scope of the present invention.

The present invention will be illustrated in further detail with reference several examples below. It should be noted, however, that these examples are not intended to limit the scope of the present invention, and various alternations and modifications may be made without departing the scope and spirit of the present invention.

Experimental Examples

A series of sample steels having the chemical compositions shown in Table 1 with the balance being iron and inevitable impurities was melted through vacuum melting process, cast, and thereby yielded a series of cast ingots.

Next, the cast ingots were heated to the slab reheating temperatures (SRT) in Table 2, hot-rolled, coiled at the coiling temperatures (CT) in Table 2, and thereby yielded hot rolled steel sheets 3 mm thick. The finishing delivery temperatures (FDT) in hot rolling and the average cooling rates (CR) from the finishing delivery temperatures (FDT) to the coiling temperatures (CT) are also shown in Table 2.

The metal structures of the hot rolled steel sheets were observed in the following manner.

[Metal Structure]

A cross-section in a thickness direction of a sample hot rolled steel sheet was etched with a repeller to enable visual distinction between bainitic ferrite and other phases typified by martensite and bainite. Next, the structure was observed with an optical microscope at a magnification of 1000. Based on this observation, the area percentages of bainitic ferrite and other phases typified by martensite and bainite were determined with an image analyzer "LUZEX-F" supplied from NIRECO Corporation. The area percentages of respective microstructures are shown in Table 2. Remainder microstructures other than bainitic ferrite (BF), martensite (M), and bainite (B) included polygonal ferrite and/or pearlite.

The photomicrograph of Sample No. 2 (sample according to an embodiment of the present invention) in Table 2 observed under an optical microscope is shown in FIG. 1. In FIG. 1, a gray area indicates a bainitic ferrite phase, and a white area indicates a martensite phase. The sample in FIG. 1 does not contain a bainite phase.

Next, there were made measurements of the hot rolled steel sheets on mechanical properties including tensile strength, yield strength, elongation, yield ratio, hole expansion ratio, and minimum bending radius according to the following methods. Test pieces used in the measurements of the mechanical properties were prepared by subjecting the hot rolled steel sheets to machining on both sides to a thickness of 2 mm, so as to remove scale on surface of the hot rolled steel sheets.

[Tensile Strength, Yield Strength, Elongation, and Yield Ratio]

A No. 5 test piece for tensile test according to Japanese Industrial Standards (JIS) was prepared from a sample hot rolled steel sheet (2 mm thick) after machining and subjected to a tensile test with a tensile tester "AG-100 (tradename)" supplied from Shimadzu Corporation. In the tensile test, the tensile strength (TS), yield strength (YS), and elongation rate (El) were measured respectively. The results are shown in Table 3 below. A sample having a tensile strength (TS) of 980 MPa or more is acceptable herein.

For evaluating shape freezing ability as press workabilities, a yield ratio was calculated as the percentage of YS to TS

[YR=(YS/TS)×100]. The results are shown in Table 3. A sample having a yield ratio (YR) of 80% or less is acceptable herein.

[Hole Expansion Ratio]

The hole expansion ratio (λ; in unit of %) was calculated in the following manner to determine hole-expandability as press workabilities. A hole having an initial hole diameter ($d_1$) of 10 mm was punched through a sample hot rolled steel sheet after machining, and this hole was dilated with a conical punch having an apical angle of 60 degrees. When the crack generated reached the other surface of the steel sheet, hole diameter ($d_2$) was measured to determine the hole expansion ratio (λ, %) according to the following equation. The results are shown in Table 3. A sample having λ of 70% or more is acceptable herein.

$$\text{Hole expansion ratio } (\lambda)=[(d_2-d_1)/d_1]\times 100 \quad (3)$$

[Minimum Bending Radius]

The minimum bending radius (in unit of mm) was determined in the following manner so as to evaluate bendability as press workabilities. A strip test piece 20 mm wide was cut from a sample hot rolled steel sheet after machining so that the longitudinal direction of the strip is the direction perpendicular to the rolling direction, and this strip test piece was bent with a series of bending tools (punch and die) having a V-shaped cross-section at an angle of 60 degrees and having predetermined bending radii. Whether cracks occurred or not upon bending was visually observed at the respective bending radii, and the smallest radius at which no crack occurred was determined. The results are shown in Table 3. A sample having a minimum bending radius of 2.0 mm or less is acceptable herein.

TABLE 1

| | Chemical composition (percent by mass) | | | | | | | | | | |
|---|---|---|---|---|---|---|---|---|---|---|---|
| Steel | C | Si | Mn | P | S | Al | Ti | N | Others | Y value | Z value |
| a | 0.039 | 2.01 | 2.96 | 0.009 | 0.0013 | 0.036 | 0.160 | 0.0027 | | 0.002 | 0.68 |
| b | 0.079 | 0.62 | 2.27 | 0.010 | 0.0022 | 0.034 | 0.170 | 0.0039 | Cu: 0.31, Ni: 0.15, V: 0.082 | 0.041 | 0.27 |
| c | 0.060 | 1.51 | 1.99 | 0.010 | 0.0021 | 0.034 | 0.150 | 0.0030 | Nb: 0.025 | 0.026 | 0.76 |
| d | 0.077 | 0.60 | 2.30 | 0.010 | 0.0010 | 0.033 | 0.166 | 0.0038 | Cu: 0.29, Ni: 0.12 | 0.039 | 0.26 |
| e | 0.060 | 1.50 | 1.63 | 0.009 | 0.0010 | 0.016 | 0.151 | 0.0030 | Nb: 0.025 | 0.025 | 0.92 |
| f | 0.034 | 0.99 | 1.40 | 0.009 | 0.0013 | 0.031 | 0.156 | 0.0031 | | −0.002 | 0.71 |
| g | 0.036 | 2.01 | 1.39 | 0.009 | 0.0013 | 0.033 | 0.154 | 0.0031 | | 0.001 | 1.45 |
| h | 0.078 | 1.89 | 2.64 | 0.008 | 0.0014 | 0.037 | 0.290 | 0.0026 | | 0.008 | 0.72 |
| i | 0.033 | 0.98 | 2.97 | 0.009 | 0.0013 | 0.032 | 0.155 | 0.0031 | | −0.003 | 0.33 |
| j | 0.042 | 0.51 | 2.52 | 0.009 | 0.0012 | 0.032 | 0.172 | 0.0031 | | 0.002 | 0.20 |
| k | 0.034 | 0.64 | 3.46 | 0.009 | 0.0013 | 0.031 | 0.155 | 0.0031 | | −0.002 | 0.18 |
| l | 0.021 | 2.48 | 3.43 | 0.009 | 0.0011 | 0.034 | 0.144 | 0.0031 | | −0.012 | 0.72 |
| m | 0.049 | 2.48 | 3.49 | 0.011 | 0.0009 | 0.047 | 0.184 | 0.0046 | | 0.007 | 0.71 |
| n | 0.014 | 1.57 | 2.86 | 0.009 | 0.0014 | 0.030 | 0.160 | 0.0027 | | −0.023 | 0.55 |
| o | 0.048 | 1.76 | 2.91 | 0.008 | 0.0013 | 0.031 | 0.230 | 0.0027 | | −0.007 | 0.60 |
| p | 0.034 | 0.82 | 2.79 | 0.009 | 0.0011 | 0.031 | 0.155 | 0.0031 | Cu: 0.06 | −0.002 | 0.29 |
| q | 0.037 | 1.21 | 2.76 | 0.009 | 0.0013 | 0.032 | 0.155 | 0.0031 | Ni: 0.14 | 0.001 | 0.44 |
| r | 0.036 | 1.33 | 2.79 | 0.007 | 0.0012 | 0.031 | 0.155 | 0.0031 | Cr: 0.5 | 0 | 0.48 |
| s | 0.038 | 1.26 | 2.77 | 0.009 | 0.0013 | 0.033 | 0.153 | 0.0031 | Mo: 0.04 | 0.003 | 0.45 |
| t | 0.035 | 0.92 | 2.67 | 0.009 | 0.0011 | 0.031 | 0.156 | 0.0031 | Nb: 0.017 | −0.001 | 0.34 |
| u | 0.035 | 1.46 | 2.98 | 0.011 | 0.0013 | 0.030 | 0.152 | 0.0031 | V: 0.02 | 0 | 0.49 |
| v | 0.038 | 0.99 | 3.02 | 0.009 | 0.0013 | 0.031 | 0.156 | 0.0031 | B: 0.0015 | 0.002 | 0.33 |
| w | 0.034 | 1.14 | 2.84 | 0.009 | 0.0021 | 0.038 | 0.154 | 0.0031 | Ca: 0.0022 | −0.001 | 0.40 |
| x | 0.007 | 1.22 | 2.85 | 0.010 | 0.0013 | 0.031 | 0.080 | 0.0031 | Cu: 0.11, Ni: 0.04 | −0.010 | 0.43 |
| y | 0.039 | 1.34 | 2.91 | 0.009 | 0.0019 | 0.027 | 0.157 | 0.0031 | Ni: 0.06, Mo: 0.03 | 0.003 | 0.46 |
| z | 0.037 | 2.68 | 3.48 | 0.009 | 0.0013 | 0.031 | 0.158 | 0.0031 | Cr: 0.7, B: 0.0009 | 0.001 | 0.77 |
| α | 0.038 | 0.27 | 2.52 | 0.008 | 0.0013 | 0.034 | 0.155 | 0.0031 | Cr: 0.2, Mo: 0.08 | 0.002 | 0.11 |
| β | 0.041 | 1.22 | 3.74 | 0.009 | 0.0014 | 0.031 | 0.172 | 0.0031 | Nb: 0.032 V: 0.04 | 0.001 | 0.33 |
| γ | 0.036 | 1.31 | 2.79 | 0.009 | 0.0013 | 0.038 | 0.155 | 0.0031 | B: 0.0015, Ca: 0.0022 | 0 | 0.47 |
| δ | 0.048 | 1.29 | 2.88 | 0.008 | 0.0012 | 0.029 | 0.340 | 0.0031 | B: 0.0015, Ca: 0.0023 | −0.034 | 0.45 |

TABLE 2

| | | Hot rolling condition | | | | Microstructure (percent by area) | | | | |
|---|---|---|---|---|---|---|---|---|---|---|
| | | | | | | | | | Remainder | |
| Sample No. | Steel | SRT (° C.) | FDT (° C.) | CR (° C./s) | CT (° C.) | BF | M | B | Area percentage | Microstructure |
| 1 | a | 1250 | 925 | 70 | 450 | 96 | 1 | 3 | 0 | |
| 2 | a | 1250 | 925 | 70 | 400 | 97 | 3 | 0 | 0 | |
| 3 | a | 1250 | 920 | 60 | 30 | 59 | 37 | 4 | 0 | |
| 4 | a | 1250 | 920 | 70 | 250 | 83 | 14 | 3 | 0 | |
| 5 | a | 1250 | 920 | 70 | 650 | 52 | 0 | 0 | 48 | polygonal ferrite and pearlite |
| 6 | b | 1250 | 880 | 170 | 350 | 76 | 11 | 13 | 0 | |
| 7 | c | 1250 | 920 | 140 | 30 | 78 | 13 | 9 | 0 | |
| 8 | d | 1250 | 870 | 200 | 350 | 81 | 8 | 11 | 0 | |
| 9 | e | 1250 | 910 | 140 | 30 | 77 | 12 | 11 | 0 | |
| 10 | f | 1250 | 920 | 70 | 450 | 86 | 0 | 0 | 14 | polygonal ferrite |
| 11 | g | 1250 | 920 | 70 | 450 | 29 | 0 | 0 | 71 | polygonal ferrite |
| 12 | h | 1250 | 943 | 80 | 400 | 88 | 9 | 3 | 0 | |

TABLE 2-continued

| Sample No. | Steel | Hot rolling condition SRT (° C.) | FDT (° C.) | CR (° C./s) | CT (° C.) | Microstructure (percent by area) BF | M | B | Remainder Area percentage | Microstructure |
|---|---|---|---|---|---|---|---|---|---|---|
| 13 | i | 1250 | 900 | 80 | 450 | 94 | 1 | 5 | 0 | |
| 14 | j | 1250 | 880 | 70 | 450 | 93 | 2 | 5 | 0 | |
| 15 | k | 1250 | 870 | 70 | 450 | 91 | 7 | 2 | 0 | |
| 16 | l | 1250 | 928 | 80 | 450 | 94 | 1 | 5 | 0 | |
| 17 | m | 1250 | 921 | 70 | 400 | 98 | 1 | 1 | 0 | |
| 18 | n | 1250 | 925 | 70 | 450 | 96 | 0 | 4 | 0 | |
| 19 | o | 1250 | 930 | 70 | 450 | 96 | 0 | 4 | 0 | |
| 20 | p | 1250 | 920 | 70 | 450 | 97 | 0 | 3 | 0 | |
| 21 | q | 1250 | 920 | 70 | 450 | 97 | 1 | 2 | 0 | |
| 22 | r | 1250 | 920 | 70 | 450 | 95 | 1 | 4 | 0 | |
| 23 | s | 1250 | 920 | 70 | 450 | 95 | 0 | 5 | 0 | |
| 24 | t | 1250 | 910 | 70 | 450 | 96 | 0 | 4 | 0 | |
| 25 | u | 1250 | 915 | 70 | 500 | 97 | 2 | 1 | 0 | |
| 26 | v | 1250 | 910 | 70 | 500 | 95 | 1 | 4 | 0 | |
| 27 | w | 1250 | 920 | 70 | 500 | 95 | 1 | 4 | 0 | |
| 28 | x | 1250 | 920 | 60 | 500 | 84 | 0 | 0 | 16 | polygonal ferrite |
| 29 | y | 1250 | 920 | 80 | 500 | 95 | 1 | 4 | 0 | |
| 30 | z | 1250 | 940 | 80 | 500 | 46 | 12 | 2 | 40 | polygonal ferrite |
| 31 | α | 1250 | 920 | 70 | 550 | 90 | 7 | 3 | 0 | |
| 32 | β | 1250 | 920 | 80 | 550 | 83 | 11 | 6 | 0 | |
| 33 | γ | 1250 | 920 | 60 | 300 | 96 | 0 | 4 | 0 | |
| 34 | δ | 1250 | 945 | 70 | 300 | 87 | 9 | 4 | 0 | |

SRT: slab reheating temperature,
FDT: finishing delivery temperature,
CR: average cooling rate,
CT: coiling temperature,
BF: bainitic ferrite,
M: martensite,
B: bainite

TABLE 3

| Sample No. | Mechanical properties YS (MPa) | TS (MPa) | YR (%) | El (%) | λ (%) | Minimum bending radius (mm) |
|---|---|---|---|---|---|---|
| 1 | 727 | 1015 | 72 | 10.9 | 85 | 1.5 |
| 2 | 722 | 1020 | 71 | 10.4 | 81 | 1.0 |
| 3 | 843 | 1173 | 72 | 8.9 | 68 | 2.5 |
| 4 | 782 | 1097 | 71 | 10.2 | 64 | 3.0 |
| 5 | 586 | 763 | 77 | 24.3 | 98 | 1.5 |
| 6 | 775 | 907 | 85 | 9.7 | 57 | 4.5 |
| 7 | 705 | 944 | 75 | 10.1 | 69 | 3.0 |
| 8 | 766 | 990 | 77 | 12.2 | 76 | 4.0 |
| 9 | 872 | 1012 | 86 | 11.6 | 82 | 3.0 |
| 10 | 689 | 802 | 86 | 20.5 | 102 | 1.0 |
| 11 | 468 | 691 | 68 | 28.7 | 141 | 1.5 |
| 12 | 703 | 993 | 71 | 12.3 | 59 | 3.5 |
| 13 | 762 | 1021 | 75 | 11.7 | 84 | 1.0 |
| 14 | 732 | 1013 | 72 | 11.8 | 85 | 0.5 |
| 15 | 767 | 1052 | 73 | 11.3 | 57 | 2.5 |
| 16 | 746 | 1027 | 73 | 11.6 | 85 | 1.0 |
| 17 | 923 | 1196 | 77 | 10.3 | 78 | 1.5 |
| 18 | 729 | 993 | 73 | 11.9 | 86 | 1.0 |
| 19 | 745 | 1081 | 69 | 11.8 | 90 | 1.0 |
| 20 | 736 | 1022 | 72 | 11.9 | 86 | 1.0 |
| 21 | 749 | 1025 | 73 | 12.4 | 91 | 1.5 |
| 22 | 763 | 1031 | 74 | 12.8 | 87 | 1.0 |
| 23 | 731 | 1008 | 73 | 11.8 | 88 | 1.0 |
| 24 | 737 | 1023 | 72 | 12.3 | 86 | 1.0 |
| 25 | 750 | 1026 | 73 | 11.9 | 84 | 0.5 |
| 26 | 771 | 1018 | 76 | 11.7 | 95 | 0.5 |
| 27 | 758 | 989 | 77 | 11.6 | 91 | 1.0 |
| 28 | 733 | 921 | 80 | 15.6 | 89 | 2.0 |
| 29 | 759 | 1008 | 75 | 12.3 | 84 | 1.0 |
| 30 | 698 | 998 | 70 | 13.8 | 53 | 4.0 |
| 31 | 724 | 915 | 79 | 12.9 | 60 | 1.0 |
| 32 | 805 | 1132 | 71 | 11.5 | 53 | 3.5 |

TABLE 3-continued

| Sample No. | Mechanical properties YS (MPa) | TS (MPa) | YR (%) | El (%) | λ (%) | Minimum bending radius (mm) |
|---|---|---|---|---|---|---|
| 33 | 747 | 1016 | 74 | 12.1 | 86 | 1.0 |
| 34 | 873 | 1109 | 79 | 9.7 | 48 | 4.0 |

Table 3 demonstrates as follows. Samples Nos. 1, 2, 13, 14, 16 to 27, 29, and 33 are examples which satisfy requirements in manufacturing conditions, element composition, and microstructure of steel sheets. They therefore have both high strengths in terms of tensile strength of 980 MPa or more and satisfactory press workabilities.

Samples Nos. 3 to 5 do not have desired mechanical properties, because they are prepared at coiling temperatures out of the above-specified range and thereby fail to have a bainitic ferrite-based microstructure.

Samples Nos. 6 to 9 have excessively large minimum bending radii and are poor in bendability, because they have carbon contents and Y values exceeding the above-specified ranges, thereby contain large amounts of martensite and/or bainite and fail to have a bainitic ferrite-based microstructure.

Sample No. 12 is out of the above-specified range only in the carbon content, contains a large amount of martensite, and thereby fails to have a bainitic ferrite-based microstructure. It has a small λ and is poor in hole-expandability. It also has a large minimum bending radius and is poor in bendability.

Samples Nos. 10 and 11 have Mn contents below the above-specified range, thereby contain a large amount of polygonal ferrite, and fail to have a bainitic ferrite-based microstructure. They have excessively low tensile strengths.

Among them, Sample No. 11 has a Z value exceeding the above-specified range, and this also causes a reduced tensile strength.

Samples Nos. 15 and 31 have Z values below the above-specified range. Of these, Sample No. 15 does not have well-balanced Si and Mn contents, contains a large amount of martensite, thereby has a small λ and a large minimum bending radius. Accordingly this sample is poor in hole-expandability and bendability among press workabilities. Sample No. 31 has a low Si content and has an insufficient tensile strength.

Sample No. 28 has a carbon content below the above-specified range, contains a relatively large amount of polygonal ferrite and an insufficient amount of bainitic ferrite, and thereby has a low tensile strength.

Sample No. 30 has a Si content exceeding the above-specified range, contains large amounts of martensite and polygonal ferrite, and fails to contain a sufficient amount of bainitic ferrite. It therefore has a small λ and is poor in hole-expandability. It also has a large minimum bending radius and is poor in bendability.

Sample No. 31 has a Si content below the above-specified range, thereby fails to undergo sufficient solid-solution strengthening by the action of silicon, and has an insufficient tensile strength. This sample also fails to have well-balance Si and Mn contents as specified according to the condition (2), contains a large amount of martensite, thereby has a small λ, and is poor in hole-expandability.

Sample No. 32 has a Mn content exceeding the above-specified range, contains large amounts of martensite and bainite, thereby has a small λ, and is poor in hole-expandability. It also has a large minimum bending radius and is poor in bendability.

Sample No. 34 has a Ti content exceeding the above-specified range and contains an excessively large amount of dissolved titanium. It also contains a large amount of martensite, has a small λ and a large minimum bending radius. It is therefore poor in hole-expandability and bendability among press workabilities.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A hot rolled steel sheet comprising Fe and:
0.010 to 0.05 percent by mass carbon (C);
0.5 to 2.5 percent by mass silicon (Si);
2.5 to 3.5 percent by mass manganese (Mn);
0.01 to 0.1 percent by mass aluminum (Al);
0.30 percent by mass or less titanium (Ti);
0.3 percent by mass or less nickel (Ni);
0.008 percent by mass or less nitrogen (N); and
0.005 percent by mass or less sulfur (S),
wherein the contents of C, Ti, N, and S satisfy following condition (1):

$$[C]-\{[Ti]-(48/14)\times[N]-(48/32)\times[S]\}/4<0.01 \quad (1), \text{ and}$$

the contents of Si and Mn satisfy following condition (2):

$$0.20<([Si]/[Mn])<0.85 \quad (2)$$

wherein
[C] represents a content of C in percent by mass,
[Ti] represents a content of Ti in percent by mass,
[N] represents a content of N in percent by mass,
[S] represents a content of S in percent by mass,
[Si] represents a content of Si in percent by mass, and
[Mn] represents a content of Mn in percent by mass,
wherein the hot rolled steel sheet has a microstructure comprising:
an area percentage of bainitic ferrite of 90 percent by area or more;
an area percentage of martensite of 5 percent by area or less; and
an area percentage of bainite of 5 percent by area or less, based on the area of an observed field, and
wherein a tensile strength of the steel is 980 MPa or higher; a hole expansion ratio λ of the steel is 70% or more; and a value of a tensile strength of the steel (MPa)×a hole expansion ratio λ of the steel (%) is equal to or larger than 81,804 MPa·%.

2. The hot rolled steel sheet according to claim 1, further comprising at least one selected from the group consisting of:
0.03 to 0.5 percent by mass copper (Cu),
0.03 to 0.3 percent by mass nickel (Ni),
0.1 to 0.8 percent by mass chromium (Cr),
0.01 to 0.5 percent by mass molybdenum (Mo),
0.005 to 0.1 percent by mass niobium (Nb),
0.005 to 0.1 percent by mass vanadium (V), and
0.0005 to 0.005 percent by mass boron (B).

3. The hot rolled steel sheet according to claim 1, further comprising 0.0005 to 0.005 percent by mass calcium (Ca).

4. The hot rolled steel sheet according to claim 1, wherein the hot rolled steel sheet has a microstructure has:
an area percentage of bainitic ferrite of 90 percent by area or more;
an area percentage of martensite of equal to or less than 5 percent but greater than zero percent; and
an area percentage of bainite of 5 percent or less.

5. The hot rolled steel sheet according to claim 1, wherein the hot rolled steel sheet has a microstructure has:
an area percentage of bainitic ferrite of 90 percent by area or more;
an area percentage of martensite of equal to or less than 5 percent but greater than zero percent; and
an area percentage of bainite of equal to or less than 5 percent but greater than zero percent.

6. The hot rolled steel sheet according to claim 1, wherein a tensile strength of the steel is 980 MPa or higher; and a value of a tensile strength of the steel (MPa)×a hole expansion ratio λ of the steel (%) is equal to or larger than 81,804 MPa·% and equal to or less than 97431 MPa·%.

7. The hot rolled steel sheet according to claim 1, wherein the hole expansion ratio λ of the steel is 78% or more.

8. The hot rolled steel sheet according to claim 1, wherein the steel comprises 0.7 to 2.5 percent by mass of Si.

9. The hot rolled steel sheet according to claim 1, where the content of Mn in the steel sheet is in a range of from 3.02 to 3.49 percent by mass.

10. The hot rolled steel sheet according to claim 1, where the content of Si in the steel sheet is in a range of from 2.01 to 2.48 percent by mass.

11. A method of manufacturing the hot rolled steel sheet of claim 1, comprising:
hot-rolling a steel slab at 1100° C. or higher with finish rolling at a finishing delivery temperature equal to or higher than an $Ar_3$ transformation temperature to yield a hot rolled steel sheet;

cooling the hot rolled steel sheet from the finishing delivery temperature to a coiling temperature at an average cooling rate of 50° C. per second or more to yield a cooled steel sheet; and coiling the cooled steel sheet at a temperature of 600° C. to 300° C., wherein the steel slab comprises:

0.010 to 0.05 percent by mass carbon (C);

0.5 to 2.5 percent by mass silicon (Si);

2.5 to 3.5 percent by mass manganese (Mn);

0.01 to 0.1 percent by mass aluminum (Al);

0.30 percent by mass or less titanium (Ti);

0.008 percent by mass or less nitrogen (N); and 0.005 percent by mass or less sulfur (S).

* * * * *